US010006175B2

(12) United States Patent
Bornemann et al.

(10) Patent No.: US 10,006,175 B2
(45) Date of Patent: Jun. 26, 2018

(54) SOIL COMPACTOR AND METHOD FOR COMPACTING SUBSTRATES

(71) Applicant: Hamm AG, Tirschenreuth (DE)

(72) Inventors: Detlef Bornemann, Leonberg (DE); Klaus Meindl, Bärnau (DE)

(73) Assignee: Hamm AG, Tirschenreuth (DE)

( * ) Notice: Subject to any disclaimer, the term of this patent is extended or adjusted under 35 U.S.C. 154(b) by 0 days. days.

(21) Appl. No.: 15/378,190

(22) Filed: Dec. 14, 2016

(65) Prior Publication Data

US 2017/0175344 A1 Jun. 22, 2017

(30) Foreign Application Priority Data

Dec. 18, 2015 (DE) ..... 10 2015 122 161

(51) Int. Cl.
*E01C 19/00* (2006.01)
*E01C 19/23* (2006.01)
*E01C 19/26* (2006.01)

(52) U.S. Cl.
CPC ..... *E01C 19/238* (2013.01); *E01C 19/23* (2013.01); *E01C 19/26* (2013.01)

(58) Field of Classification Search
CPC ..... E01C 19/23; E01C 19/238; E01C 19/26
USPC ..... 404/72, 117, 129
See application file for complete search history.

(56) References Cited

U.S. PATENT DOCUMENTS 4,009,967 A * 3/1977 Layton ..... B05B 3/085 239/223
4,421,435 A * 12/1983 Zemke ..... E01C 19/402 404/113
5,222,828 A * 6/1993 Magalski ..... E01C 19/238 180/20
5,942,679 A * 8/1999 Sandstrom ..... E01C 19/26 404/133.05
5,988,940 A * 11/1999 Johansson ..... E01C 19/238 15/256.51
6,236,923 B1 5/2001 Corcoran et al.
(Continued)

FOREIGN PATENT DOCUMENTS

DE 1175260 8/1964
DE 102007019419 10/2008
(Continued)

OTHER PUBLICATIONS

Search Report of European Application No. 16203935.8 dated May 15, 2017, 8 pages.
(Continued)

*Primary Examiner* — Raymond W Addie
(74) *Attorney, Agent, or Firm* — Rankin, Hill & Clark LLP

(57) ABSTRACT

A soil compactor comprises at least one compacting roller (18, 22) rotatable about an axis of rotation, a temperature detecting device (42) for providing temperature information representing a temperature of a substrate ($U_1$, $U_2$, $U_3$) in the area of the soil compactor (10), a sprinkling device (24, 28) assigned to at least one compacting roller (18, 22) for sprinkling this compacting roller (18, 22) with fluid, and a control device (40) for controlling at least one sprinkling device (24, 28) and/or for generating a sprinkling indicator on the basis of the temperature information.

16 Claims, 4 Drawing Sheets

(56) References Cited

U.S. PATENT DOCUMENTS

| | | | | |
|---|---|---|---|---|
| 8,500,363 | B1 * | 8/2013 | Ries | E01C 19/264 404/104 |
| 8,714,869 | B1 | 5/2014 | Ries et al. | |
| 2003/0108389 | A1 * | 6/2003 | Codina | B06B 1/04 404/117 |
| 2004/0018053 | A1 * | 1/2004 | Starry, Jr. | E01C 19/238 404/129 |
| 2008/0014020 | A1 * | 1/2008 | Hall | E01C 23/065 404/90 |
| 2008/0260462 | A1 | 10/2008 | Ackermann | |
| 2008/0292401 | A1 * | 11/2008 | Potts | E01C 19/238 404/95 |
| 2010/0172696 | A1 * | 7/2010 | Commuri | E01C 19/288 404/117 |
| 2013/0108367 | A1 * | 5/2013 | Bornemann | E02D 3/026 404/129 |
| 2015/0167258 | A1 * | 6/2015 | Ries | E01C 19/238 404/84.05 |

FOREIGN PATENT DOCUMENTS

| | | |
|---|---|---|
| EP | 1 046 748 | 10/2000 |
| FR | 1464849 | 1/1967 |
| JP | 60-107106 | 6/1985 |
| JP | 03-176502 | 7/1991 |
| JP | 03-287904 | 12/1991 |
| JP | 04-53805 | 2/1992 |
| JP | 09-78523 | 3/1997 |
| JP | 2602688 | 11/1999 |
| JP | 2002-212911 | 8/2000 |
| JP | 2001-506718 | 5/2001 |
| JP | 2002-115207 | 4/2002 |
| JP | 2005-97958 | 4/2005 |
| JP | 2007-132080 | 5/2007 |
| JP | 2008-268217 | 11/2008 |
| JP | 2008-285915 | 11/2008 |
| JP | 201521363 | 2/2015 |
| JP | 2015-200133 | 11/2015 |
| WO | 2011063638 | 6/2011 |

OTHER PUBLICATIONS

Search Report of DE Application No. 102015122161.6 dated Sep. 30, 2016, 8 pages.

Office Action of Japanese serial No. 2016-244121, dated Jan. 15, 2018; 5 pages.

* cited by examiner

SOIL COMPACTOR AND METHOD FOR COMPACTING SUBSTRATES

The present invention relates to a soil compactor, which may be used, for example, for compacting asphalt applied in a flowable state during road construction. Furthermore, the invention relates to a method for compacting of substrates, for example, substrates constructed using asphalt material.

During compaction of substrates constructed from strongly adhesive materials, like asphalt, fluid, for example, water is applied to the outer circumferential surface to prevent an adhesion of the material of the substrate on the outer circumferential surface of a compacting roller of the soil compactor: the compacting roller is thus sprinkled. To distribute this fluid on the outer circumferential surface of a compacting roller across the entire length of the compacting roller, scraper/distribution devices may also be used, for example, which comprise one or more blade-like scraper/distribution elements. These contact the outer circumferential surface of each compacting roller and cause adhesive material to be scraped off and contribute to a distribution of the fluid applied to the outer circumferential surface of a compacting roller.

It is the object of the present invention to provide a soil compactor and a method for compacting substrates in which the adhesion of material of the substrate to be contact on the outer circumferential surface of one or more compacting rollers of a soil compactor may be reliably prevented.

According to the invention, this problem is solved by a soil compactor comprising:

- at least one compacting roller rotatable about an axis of rotation,
- a temperature detecting device for providing temperature information representing a temperature of a substrate in the area of the soil compactor,
- a sprinkling device assigned to at least one compacting roller for sprinkling this compacting roller with fluid,
- a control device for controlling at least one sprinkling device and/or for generating a sprinkling indicator on the basis of the temperature information.

In the soil compactor designed according to the invention, the temperature detecting device provides information for evaluating whether the sprinkling of a compacting roller is necessary or not. In particular during compacting of asphalt, the risk of adhesion of the construction material of a substrate constructed using asphalt is highly dependent on the asphalt temperature. Upon transitioning from, for example, a terrain positioned to the side next to the substrate to be compacted to the terrain constructed using the substrate to be compacted, in particular if this substrate to be compacted is constructed using asphalt material, a significant temperature increase is recognizable, which may be used according to the invention to determine that a soil compactor has moved into an area with a substrate to be compacted, in which there is a basic risk of adhesion of the construction material of the substrate an the outer circumferential surface of one or more compacting rollers, so that the sprinkling device may be activated and fluid may be applied to the outer circumferential surface of the compacting roller. In an automated system of this type, in addition to the activation of one or more sprinkling devices, a sprinkling indicator, for example an optical, acoustic, or haptic indicator, may be generated for an operator to indicate that one or more sprinkling devices are activated or have been activated. In a partially automated system, when the temperature information indicates a temperature that requires sprinkling or at which sprinkling is advantageous, a sprinkling indicator of this type is generated so that an operator is signaled that sprinkling is necessary or advantageous in the area, in which a soil compactor is moving at the moment, and the operator may activate one or more sprinkling arrangements, for example, by corresponding activation of one or more switches on the control device. Correspondingly, when a soil compactor moves into an area, in which sprinkling is no longer necessary or advantageous, which may likewise be identified on the basis of the temperature information, a previously activated sprinkling device may be deactivated, if necessary by ending the generation of the sprinkling indicator, or the generation of the sprinkling indicator may be stopped or a deactivation indicator may be generated so that an operator is signaled that the previously activated sprinkling devices may be deactivated.

Since the risk of adhesion of the construction material of a substrate, in particular, asphalt material, increases with increasing temperature, it is proposed according to the invention that the control device is designed to control at least one sprinkling device for sprinkling the assigned compacting roller and/or to generate the sprinkling indicator when the temperature information indicates a temperature lying above a threshold temperature. It may, for example, be provided that the threshold temperature lies in the range from 70° C. to 100° C., preferably at approximately 80° C.

To identify changes is the terrain traversed by a soil compactor, thus in particular a transition between a soil area, in which the risk of adhesion does not exist, to a soil area, in which there is a risk of adhesion due to a significantly higher temperature of the construction material of the substrate, it may additionally be provided according to an advantageous aspect of the present invention that the control device is designed to control at least one sprinkling device for sprinkling the assigned compacting roller and/or to generate the sprinkling indicator when, during movement of the soil compactor in a movement direction, the temperature information indicates a temperature gradient of the temperature of the substrate, essentially in the movement direction, which lies above a threshold temperature gradient.

A non-contact temperature detection, which may be carried out continuously during compacting operation, may be achieved in that the temperature detecting device comprises at least one, preferably a plurality, of optical temperature sensors.

Since soil compactors of this type may generally be driven in two movement directions, thus, for example, forwards and backwards to carry out a compacting process, it is further proposed according to the invention that the temperature detecting device comprises at least one temperature sensor for detecting the temperature of the substrate in front of the soil compactor during movement of the soil compactor in a first movement direction and at least one temperature sensor for detecting the temperature of the substrate in front of the soil compactor during movement of the soil compactor in a second movement direction opposite the first movement direction. Thus, regardless of the direction in which a soil compactor is moved, it may be guaranteed that information about the temperature of the substrate, on which the soil compactor moves, may be provided and consequently the control device is enabled to activate the sprinkling device of at least one compacting roller as needed.

According to another advantageous aspect, in the soil compactor according to the invention, a scraper/distribution device with at least one scraper/distribution element contactable on an outer circumferential surface of a compacting roller is provided and assigned to at least one compacting roller. The control device may be designed to control a positioning element of at least one scraper/distribution element to position at least one scraper/distribution element into a scraping/distributing operating state with a scraper/distribution element contacting the outer circumferential surface of the assigned compacting roller when the sprinkling device assigned to this compacting roller is controlled to sprinkle this compacting roller. Alternatively or additionally, the control device may be designed to generate an out of service indicator, when at least one sprinkling device is controlled for sprinkling a compacting roller, and preferably when an operating state detection device of the scraper/distribution device assigned to this compacting roller indicates that a scraper/distribution element of this scraper/distribution device is not in a scraping/distributing operating state. In this way, it may be guaranteed that, by activating a scraper/distribution device, the fluid applied onto a compacting roller is distributed across the entire outer circumferential surface and essentially no areas remain that are not wetted by fluid. In the case of a scraper/distribution device shifted by a positioning device, the shifting into the scraping/distributing operating state may be carried out using the controller of the control device. In the case of a manually-operated scraper/distribution device, an indicator may be generated so that an operator is signaled that the scraper/distribution device is not in a scraping/distributing operating state. The risk of forgetting to move the scraper/distribution device into the scraping/distributing operating state may thus be reduced. Correspondingly, when a soil compactor moves into an area, in which sprinkling is no longer necessary or advantageous, which may likewise be recognized on the basis of the temperature information, a scraper/distribution device, previously shifted into the scraping/distributing operating state, may be deactivated, or a deactivation indicator may be generated which indicates to an operator that one or more previously activated scraper/distribution devices may be deactivated.

According to one aspect of the present invention, which may be used particularly advantageously in conjunction with the previous aspects of the invention, yet may also be implemented independently, it is proposed that a roller temperature detecting device for providing roller temperature information indicating a temperature of at least one compacting roller is provided and assigned to at least one compacting roller, and that a control device is designed for controlling at least one sprinkling device and/or for generating a sprinkling indicator or a stop-sprinkling indicator on the basis of the roller temperature information to enable prevention of sprinkling of one or more compacting rollers when this is not necessary, and in this way to reduce the consumption of fluid used for sprinkling. It has been recognized, that in particular in the case of compacting rollers, which are constructed with rubber material on the outer circumference which contacts the substrate to be compacted, thus, e.g. for compacting rollers which comprise wheels designed with rubber tires, there is no risk of adhesion of the construction material of the substrate, thus, for example, asphalt, essentially when these tires have a sufficiently high temperature in the area in which they contact the substrate. If this roller temperature is taken into consideration, the sprinkling may be omitted and thus fluid may be saved in phases in which there is no actual risk of adhesion of material due to a sufficient temperature.

To implement this, the control device may be designed to control at least one sprinkling device to not sprinkle and/or to not generate the sprinkling indicator, and/or be designed to control at least one sprinkling device to stop the sprinkling and/or to generate a stop sprinkling indicator when the roller temperature information indicates a roller temperature above a roller threshold temperature.

In particular, when the area of a compacting roller in contact with the substrate to be compacted is constructed using rubber material, the roller threshold temperature may lie in the range from 70° C. to 90° C., preferably at approximately 80° C.

The soil compactor constructed according to the invention may comprise at least one compacting roller with a roller casing constructed from a metal material. Alternatively or additionally, at least one compacting roller may comprise a wheel with a tire constructed using a rubber material.

According to another aspect, the problem listed at the outset is solved by a method for compacting substrates, preferably by means of a soil compactor according to the invention, comprising the measures:

a) providing temperature information indicating a temperature of the substrate in the area of a soil compactor used for compacting, b) sprinkling at least one compacting roller of the soil compactor with fluid and/or generating a sprinkling indicator depending on the temperature information.

Since the risk of adhesion of construction material of a substrate is strongly dependent on the temperature of the construction material of the substrate or a significant temperature increase also signals the movement into a terrain with this type of substrate, it is further proposed that at least one compacting roller is sprinkled and/or the sprinkling indicator is generated when the temperature information indicates a temperature of the substrate above a threshold temperature, and/or when, during movement of the soil compactor in a movement direction, the temperature information indicates a temperature gradient of the temperature of the substrate above a threshold temperature gradient substantially in the movement direction.

To prevent the unnecessary output of fluid during operating phases, in which there is no risk of adhesion of substrate material due to sufficiently high roller temperatures, a method is provided with a measure c) for providing roller temperature information indicating a roller temperature of at least one compacting roller, in which at least one compacting roller is not sprinkled and/or a sprinkling indicator is not generated, and/or the sprinkling of at least one compacting roller is stopped and/or a stop sprinkling indicator is generated when the roller temperature information indicates a roller temperature above a roller threshold temperature.

To be able to ensure that the fluid applied onto a compacting roller is distributed uniformly on the outer circumferential surface of the compacting roller, it is further proposed that at least one scraper/distribution device assigned to a compacting roller is shifted into a scraping/distributing operating state when this compacting roller is sprinkled, and/or an out of service indicator is generated when at least one compacting roller is sprinkled, preferably when a scraper/distribution device assigned to this compacting roller is not in a scraping/distributing operating state.

The present invention is subsequently described with respect to the enclosed figures.

Figure 1:
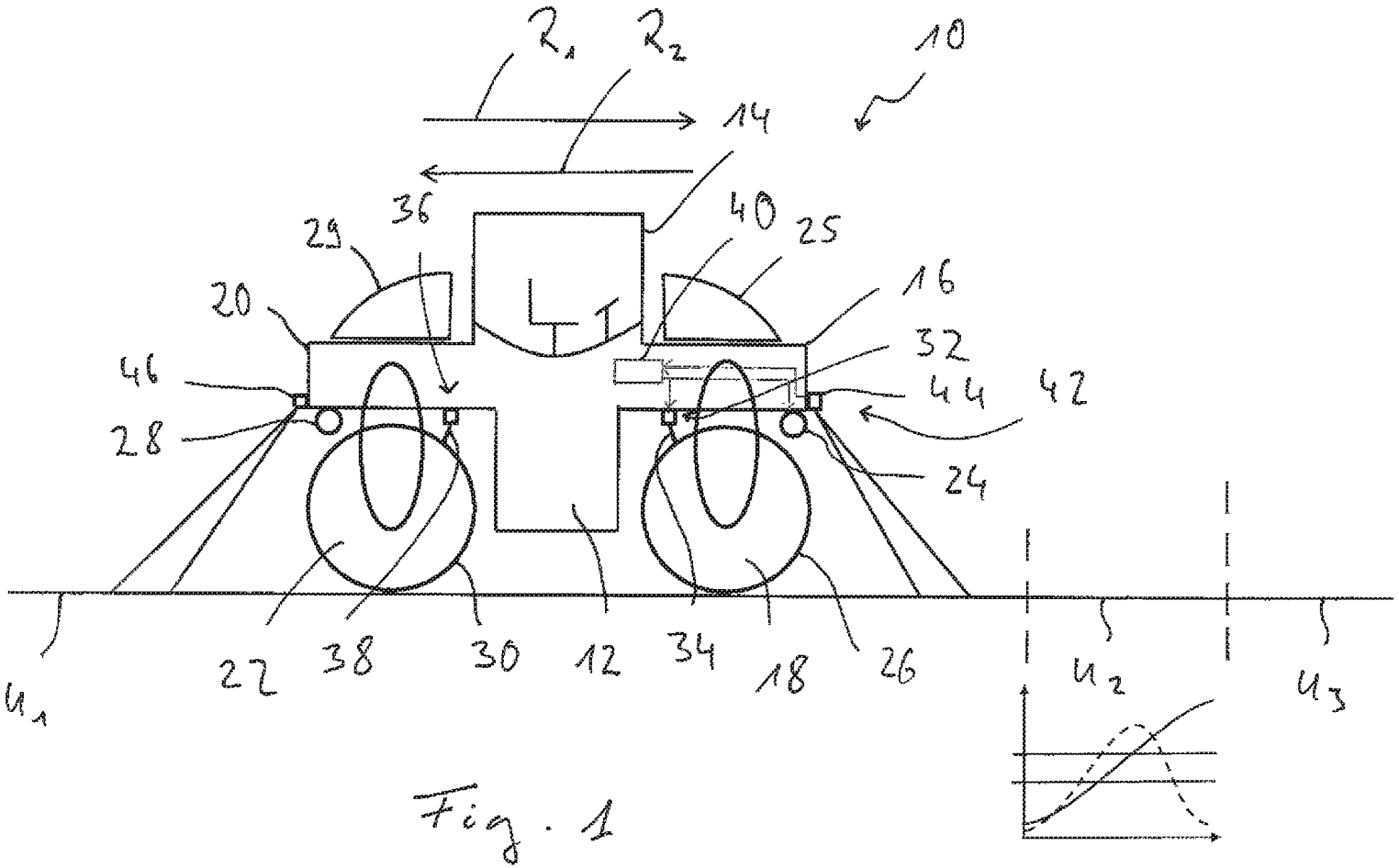
FIG. 1 shows a soil compactor moving on a substrate to be compacted in a principle representation.

FIG. 1 shows a soil compactor designated as a whole with 10. Soil compactor 10 comprises a compactor frame 12 on which, for example, a driver cabin 14 is arranged. A compacting roller 18 is arranged on a front end 16 of soil compactor 10 and is rotatable around a compacting roller axis of rotation extending orthogonal to the drawing plane of FIG. 1. Compacting roller 18 may, for example, be designed with a roller casing constructed from metal material extending in the direction of the compacting roller axis of rotation essentially across the entire width of front end 16. Another compacting roller 22 is provided on a rear end 20 of soil compactor 10 and may be designed, just like compacting roller 18, with a roller casing constructed from metal material extending in the direction of a compacting roller axis of rotation orthogonal to the drawing plane of FIG. 1 and extending substantially across the entire width of rear end 20.

Reference is made here to the fact that one or both of the compacting rollers may also be provided by one or more wheels respectively having tires constructed using a rubber material arranged adjacent to one another in the direction of respective roller axis of rotation and traversing the substrate to be compacted with their outer circumferential surfaces. These types or wheels or tires are also to be understood as rollers in the context of the present invention.

A sprinkling device 24 is assigned to compacting roller 18 provided on front end 16. This may comprise a sprayer boom extending along compacting roller 18 in the direction of the compacting roller axis of rotation, by means of which fluid supplied from a fluid reservoir 25 may be applied onto outer circumferential surface 26 of compacting roller 18, thus compacting roller 18 may be sprinkled with the fluid.

A sprinkling device 28 is assigned to compacting roller 22 provided on rear end 20. This may, for example, apply fluid supplied from a fluid reservoir 29 onto outer circumferential surface 30 of compacting roller 22 by means of a sprayer boom extending in the direction of the axis of rotation of compacting roller 22.

A scraper/distribution device 32 is assigned to compacting roller 18 provided on front end 16. This may have, for example, a scraper/distribution element 34 designed like a blade which may either be moved by a positioning element or by manual actuation into a scraping/distributing operating state contacting outer circumferential surface 26 of compacting roller 18 or into an inactive state in which scraper/distribution element 34 does not interact with outer circumferential surface 26.

Correspondingly, a scraper/distribution device 36 with a scraper/distribution element 38 is assigned to compacting roller 30 on rear end 20 and likewise may be brought into interaction with outer circumferential surface 30 of compacting roller 22 or into an inactive state.

The two sprinkling devices 24, 28 are controlled using a control device designated as a whole with 40. For example, control device 40 may be designed to activate a pump conveying fluid from respective reservoir 25 or 29 or to control valves to release the flow path for the fluid to be applied onto respective compacting roller 18 or 20 when respective compacting roller 18 or 22 is to be sprinkled with fluid.

Soil compactor 10 additionally comprises a temperature detecting device designated as a whole with 42. Temperature detecting device 42 comprises, for example, one or more temperature sensors 44 on front end 16 and may advantageously additionally comprise one or more temperature sensors 46 on rear end 20. Temperature sensors 44, 46 are preferably designed for non-contact detection of the temperature of the substrate traversed by soil compactor 10. For example, temperature sensors 44, 46 may be designed as optically functioning temperature sensors or as thermal imaging cameras.

Temperature sensor(s) 44 provided on front end 16 scan the substrate traversed by soil compactor 10 in an area in front of soil compactor 10 when soil compactor 10 moves in a movement direction $R_1$, which, for example, may correspond to a forward travel direction. Temperature sensor(s) 46 provided on rear end 20 scan the substrate traversed by soil compactor 10 in an area in front of soil compactor 10 in a travel direction when it moves in a movement direction $R_2$ which is opposite movement direction $R_1$, thus, for example, in a reverse travel direction.

The signals delivered by temperature sensors 44, 46 provide temperature information representing the temperature of the substrate in the area detected by the same. These sensor signals or this temperature information is input into control device 40 and is used by the same to activate sprinkling device 24 or 28 in the subsequently described way and to apply fluid onto compacting roller 18 or 22 if this is necessary.

In FIG. 1, soil compactor 10 is positioned in the area of a substrate $U_1$, which, for example, is already compacted or provides an access road to the substrate $U_3$ to be compacted. Substrate $U_1$ is constructed such that there is no risk of an adhesion of construction material on outer circumferential surface 26 or 30 of compacting roller 18, 22. If soil compactor 10 moves on substrate $U_1$ in movement direction $R_1$ toward substrate $U_3$ to be compacted, then control device 40 may, for example, use the temperature information delivered by temperature sensor(s) 44 provided on front end 16 as a decision criterion to not activate sprinkling devices 24, 28 assigned to the two compacting rollers 18, 22, since the temperature of substrate $U_1$ is sufficiently low. Advantageously, the temperature information from the respective temperature sensors 44 or 46 scanning the substrate in front of soil compactor 10 in the respective current movement direction $R_1$ or $R_2$ is used for this decision.

If soil compactor 10 approaches substrate $U_3$ to be compacted, thus, for example, when freshly applied and thus still very hot asphalt material is provided in the area of substrate $U_3$, whereas substrate $U_1$ had already been compacted earlier or only forms an access road, a significant temperature increase occurs in a transition area $U_2$, in particular at the surface of the substrate. In the diagram shown in FIG. 1, curve $K_1$ represents, for example, the temperature of the substrate at the surface thereof, thus essentially that temperature which is represented by a respective detection signal of temperature sensors 44 or 46. This increase in the temperature in the transition from substrate $U_1$ to substrate $U_3$ also becomes apparent in a gradient of the temperature represented in the diagram of FIG. 1 by curve $K_2$. In this case, the gradient represents the change of the temperature across the travel path or the distance between substrate $U_1$ and substrate $U_3$.

Figure 2:
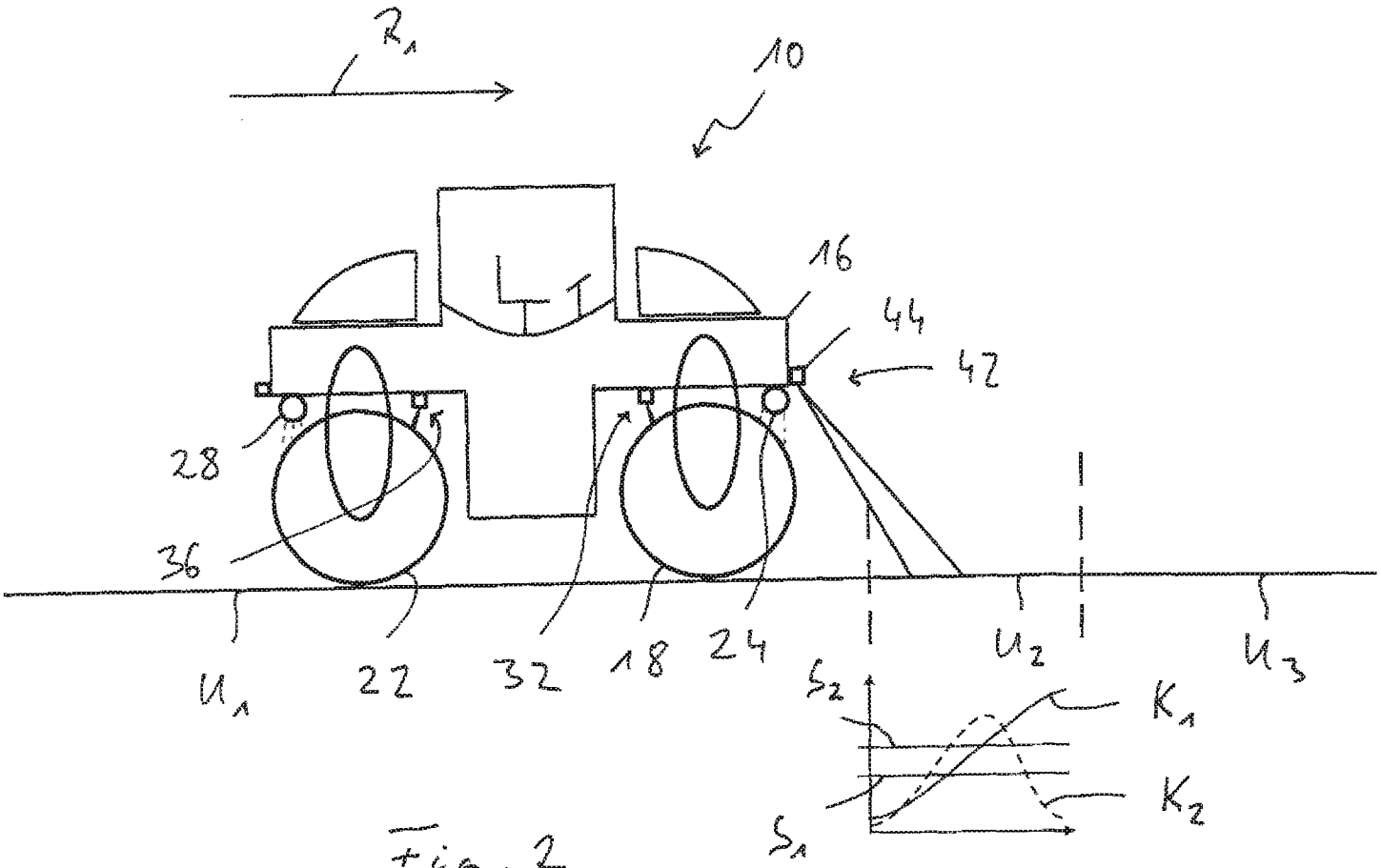
FIG. 2 shows the soil compactor from FIG. 1 closer to the substrate to be compacted.

FIG. 2 shows soil compactor 10 in a state in which it has approached transition area $U_2$ by moving in movement direction $R_1$. Temperature sensor(s) 44 provided on front end 16 now detect transition area $U_2$ lying in movement direction R in front of soil compactor 10 and thus deliver information about the temperature of the substrate in transition area $U_2$. As is clear from the diagram shown in FIGS. 1 and 2, the temperature increases significantly in transition area $U_2$. For example, a threshold temperature $S_1$ may be specified here, exceeding the same is recognized in control device 40 and the activation of sprinkling devices 24, 28 is triggered. Alternatively or additionally, exceeding a threshold gradient $S_2$ assigned to curve $K_2$ may be used as a trigger for activating sprinkling devices 24, 28.

It is thus ensured that when the temperature of the substrate becomes comparatively high or compactor 10 moves into an area in which the substrate has a comparatively high temperature, and thus there is a risk of adhesion of construction material of the substrate on compacting rollers 18 or 22, these compacting rollers are sprinkled and are wetted with a fluid film, which prevents the adhesion of material.

If it has been recognized in the previously described way that soil compactor 10 has moved into an area in which the sprinkling of one or more compacting rollers 18, 22 is necessary or advantageous, a sprinkling indicator, which is optically, acoustically, or haptically perceivable by an operator, may be generated with the activation of one or more sprinkling devices 24, 28. This signals, for example, during the entire operating period of sprinkling devices 24, 28, that the sprinkling is active. Alternatively, this type of indicator might also be generated only at the beginning, thus upon activation of one or more sprinkling devices 24, 28. In the case of a partially automated system, when it is recognized in the previously described way that the sprinkling of one or more compacting rollers 18, 22 is necessary or advantageous, a sprinkling indicator of this type is generated by control device 40. An operator is thus signaled that the sprinkling is now necessary or advantageous so that by actuating one or more corresponding switches on the control device, the operator may activate one or more sprinkling devices 24, 28. The generation of this sprinkling indicator may be ended when the sprinkling device(s) has/have been activated by an operator. For example, an active indicator may be generated, which signals to the operator that one or more of sprinkling devices 24, 28 is/are activated.

If soil compactor 10 moves out of an area in which the sprinkling was necessary or advantageous, and into an area in which this is not necessary or advantageous, this may also be recognized by evaluating the temperature information; for example, in that corresponding threshold values are underrun. The sprinkling may be stopped, thus, sprinkling devices 18, 24, which were previously activated, may be deactivated. This may be accompanied by stopping the generation of the sprinkling indicator. In a partially automated system, a deactivation indicator may be generated in this state, which signals to the operator, that the previously activated sprinkling devices may be deactivated. This indicator may be generated, for example, until the sprinkling devices are actually no longer activated.

To uniformly distribute the fluid applied by means of sprinkling devices 24, 28 onto compacting rollers 18, 22, scraper/distribution elements 34, 38, which contact outer circumferential surfaces 26, 30 in a blade-like way, may be used to distribute the applied fluid. It may; for example, be additionally provided that, when sprinkling devices 24, 28 are activated, scraper/distribution devices 32, 36 are also always brought into their scraping/distributing operating states, insofar as this is not already the case. In the case of automatically actuatable scraper/distribution devices 32, 36, this may be carried out under the control of control device 40 such that, when sprinkling devices 24, 28 are activated, this also activates scraper/distribution devices 32, 36 assigned to compacting rollers 18 or 22. In the case of non-automated scraper/distribution devices, control device 40 may generate an indicator, which is visually and/or acoustically and/or haptically perceivable, when it activates sprinkling devices 24, 28 and when it is indicated by corresponding sensors that one or both of scraper/distribution devices 32, 36 is/are not yet in their scraping/distributing operating state. Basically, this type of indicator may always be generated independent of the state of a respective scraper/distribution device when a sprinkling device is activated. The generation of this indicator may, for example, be stopped when one or more of the scraper/distribution devices have been brought by the operator into the scraping/distributing operating state. In this state, for example, an active indicator may be generated, which signals that one or more of the scraper/distribution devices are activated.

If soil compactor 10 moves into an area in which the sprinkling is no longer necessary and is therefore stopped or is to be stopped, the previously active scraper/distribution devices may be deactivated with the stopping of the sprinkling or, in the case of a partially automated system, a deactivation indicator may be generated which indicates to an operator that the previously active scraper/distribution devices may be deactivated. This indicator may, for example, be generated until the scraper/distribution devices are deactivated.

Figure 3:
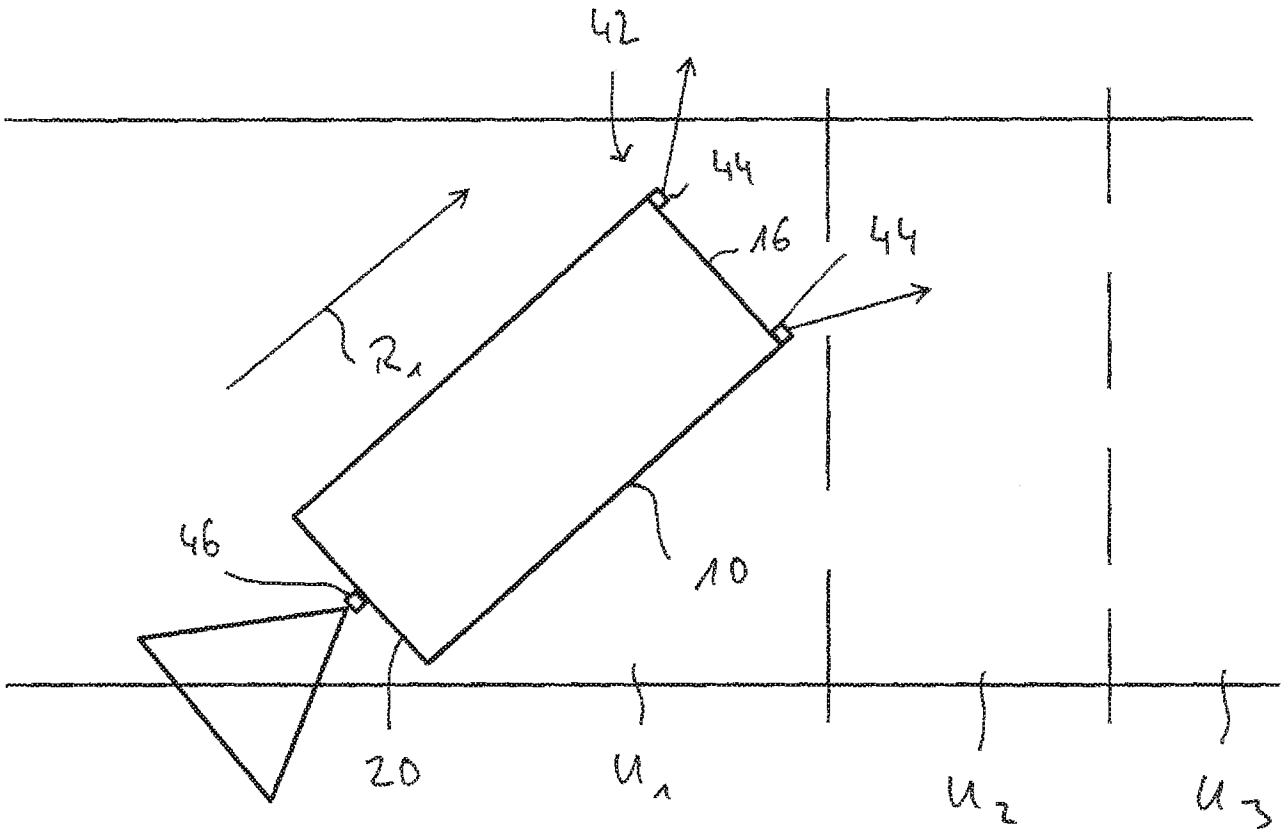
FIG. 3 shows a top view onto the soil compactor of FIG. 1 or 2 to illustrate different temperature sensor devices.

FIG. 3 shows in a top view different potential configurations of temperature detecting device 42. In the area of front end 16, two temperature sensors 44, which each detect the temperature in the area in front of front end 16 close to a corner area of soil compactor 10 or front end 16, are depicted positioned at a lateral distance, thus at distance from one another in the direction transverse to the soil compactor. This positioning guarantees that even when soil compactor 10 moves, as is shown in FIG. 3, transversely into an area, in which a higher temperature of the substrate is present or the temperature of the substrate increases significantly, this is recognized promptly and consequently the sprinkling may be started with the aid of control device 40. A temperature sensor 46 is provided on rear end 20 and is designed for linear detection of the temperature of a surface area in the area in front of rear end 20. For example, this temperature sensor 46 may be designed as a thermal imaging camera. Reference is made to the fact that different numbers and configurations may be selected for temperature sensors on front end 16 or on rear end 20. Basically, different or more or fewer temperature sensors may be provided on front end 16 than on rear end 20.

Figure 4:
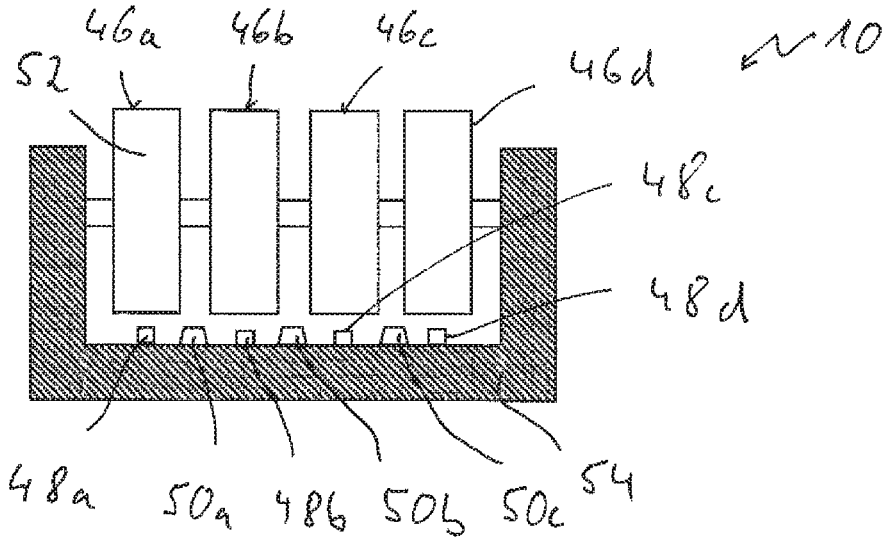
FIG. 4 shows a part of a soil compactor with a plurality of compacting rollers constructed as wheels with rubber tires in a first representation.

In FIG. 4 shows a previously already mentioned configuration of a soil compactor 10 in a principle depiction. This soil compactor 10 comprises a plurality of compacting rollers 46*a*, 46*b*, 46*c*, 46*d* on at least one of its axles which are adjacent to one another, rotatable about a common axis of rotation, and supported on a frame 54 of soil compactor 10. For example, these compacting rollers 46*a*, 46*b*, 46*c*, 46*d* may each comprise a wheel with a tire 52 constructed from a rubber material. Each of these wheels providing a compacting roller 46*a*, 46*b*, 46*c*, 46*d* contacts the substrate to be contacted with the outer circumferential area of its tire 52. To sprinkle these compacting rollers 46*a*, 46*b*, 46*c*, 46*d*, the method previously described with reference to FIGS. 1-4 is basically thereby followed. The interaction of these compacting rollers 46*a*, 46*b*, 46*c*, 46*d* with these individually or jointly assigned scraper/distribution devices may also be carried out as previously described.

In the case of compacting rollers constructed using rubber material on their outer circumference, there is a risk of adhesion of material of the substrate, in particular, asphalt, essentially only if these types of compacting rollers have a comparatively low temperature in the area contacting this material. At higher roller temperatures, there is essentially no risk of adhesion of this type of material.

According to another principle of the present invention illustrated in FIG. 4, it may therefore be provided that the temperature of at least one compacting roller is detected, wherein the temperature of the compacting roller is preferably detected in the same outer circumferential area, thus, that same area which comes into contact with the material to be compacted and, optional, the material which adheres. In the example illustrated in FIG. 4, a roller temperature detecting device 48*a*, 48*b*, 48*c*, 48*d* is provided and assigned to each compacting roller 46*a*, 46*b*, 46*c*, 46*d*. Each roller temperature detecting device 48*a*, 48*b*, 48*c*, 48*d* may, for example, comprise a temperature sensor preferably designed for optical temperature detection, which detects the temperature on the outer circumference of the assigned compacting roller 46*a*, 46*b*, 46*c*, 46*d*. The output signals representing a respective roller temperature from the roller temperature detecting devices 48*a*, 48*b*, 48*c*, 48*d* may be input, for example, into control device 40 shown in FIG. 1, which may also generate corresponding control commands for sprinkling devices 50*a*, 50*b*, 50*c* on the basis of these output signals. If the roller temperature of a respective compacting roller 46*a*, 46*b*, 46*c*, 46*d* is below a roller threshold temperature, which may lie in the range from 70-90° C., preferably at approximately 80° C., the sprinkling device 50*a*, 50*b*, 50*c* assigned to a respective compacting roller 46*a*, 46*b*, 46*c*, 46*d* is activated to sprinkle the surface of the roller with fluid, for example, water. If the roller temperature exceeds this roller threshold temperature, which, for example, may be the case after longer contact with the construction material of the substrate to be compacted, a continued sprinkling is no longer necessary. The sprinkling device 50*a*, 50*b*, 50*c* assigned to a respective compacting roller 46*a*, 46*b*, 46*c*, 46*d* may therefore be deactivated by, for example, control device 40. The scraper/distribution device assigned to a respective compacting roller 46*a*, 46*b*, 46*c*, 46*d* may also be deactivated. It is alternatively possible that a stop sprinkling indicator, which indicates to an operator that a continued sprinkling is no longer necessary, is generated by control device 40. This may deactivate sprinkling devices 50*a*, 50*b*, 50*c* and, if necessary, stop the operation of the scraper/distribution device assigned to a respective compacting roller 46*a*, 46*b*, 46*c*, 46*d*. A stop sprinkling indicator of this type might, for example, also be provided in that a previously generated sprinkling indicator is no longer generated.

FIG. 4 shows by way of example a roller temperature detecting device 48*a*, 48*b*, 48*c*, 48*d* assigned to each compacting roller 46*a*, 46*b*, 46*c*, 46*d* and interacting with the same. Thus, the temperature of each compacting roller 46*a*, 46*b*, 46*c*, 46*d* may be detected and, it may be autonomously decided in conjunction with each compacting roller 46*a*, 46*b*, 46*c*, 46*d* whether it should be sprinkled or not. For this purpose, a sprinkling device is provided, assigned to each compacting roller 46*a*, 46*b*, 46*c*, 46*d* and interacting only with the same. In the example shown in FIG. 4, each of three sprinkling devices 50*a*, 50*b*, 50*c* shown interacts with two compacting rollers arranged directly adjacent to one another, which contributes to a simplified construction. In another alternative configuration, one roller temperature detecting device might be provided, for example, assigned to only one single compacting roller, since it may basically be assumed that when one of them has a roller temperature above the roller threshold temperature, that this also applies for the other compacting rollers.

Reference is consequently made to the fact that in the case of a soil compactor constructed according to the invention, the sprinkling devices may be designed in different ways. They may, for example, output the fluid to be applied to a respectively assigned compacting roller essentially pressure-free; however, they may alternatively also be designed for spraying the fluid. Furthermore, it may be provided, for example, that one sprinkling device is provided assigned to only one of multiple compacting rollers. The activation of a respective scraper/distribution device when a compacting roller is sprinkled with fluid, may, for example, be carried out in the method in that a corresponding control signal is generated in control device 40 for the sprinkling device on the one hand and for the scraper/distribution device on the other, independently of one another and in each case based on the temperature information, e.g. when a threshold specified as a reference is exceeded. Alternatively, the generation of the control signal for the sprinkling device may be used, for example, as a trigger for the generation of a control signal for the scraper/distribution device. These two devices are also advantageously activated simultaneously. Alternatively, the two devices may also be activated independently from one another or chronologically offset from one another; for example, in the sense that the scraper/distribution device is only brought into its scraping/distributing operating state when a certain amount of fluid has been applied to the outer circumferential surface of the assigned compacting roller, thus, for example, the sprinkling device has already been operated for a predefined lead time interval; or that the scraper/distribution device is initially activated and the sprinkling device is only subsequently activated. These approaches also mean, in the context of the present invention, that the scraper/distribution device is activated when the sprinkling device is activated.

The invention claimed is:

1. A soil compactor, comprising at least one compacting roller rotatable about an axis of rotation, wherein:

a temperature detecting device for providing temperature information representing a temperature of a substrate in the area of the soil compactor, a sprinkling arrangement assigned to at least one compacting roller for sprinkling this compacting roller with fluid, a control device for controlling at least one sprinkling device and/or for generating a sprinkling indicator on the basis of the temperature information, and a roller temperature detecting device, assigned to the at least one compacting roller to provide roller temperature information indicating a temperature of the at least one compacting roller, and that the control device is designed for controlling the at least one sprinkling device and/or for generating the sprinkling indicator or a stop-sprinkling indicator on the basis of the roller temperature information.

2. The soil compactor according to claim 1, wherein the control device is designed to control the at least one sprinkling device for sprinkling the assigned compacting roller and/or for generating the sprinkling indicator when the temperature information indicates a temperature of the substrate above a threshold temperature.

3. The soil compactor according to claim 2, wherein the threshold temperature lies in the range from 70° C. to 100° C., preferably at approximately 80° C.

4. The soil compactor according to claim 1, wherein the control device is designed to control the at least one sprinkling device for sprinkling the assigned compacting roller and/or for generating the sprinkling indicator when, during movement of the soil compactor in a movement direction, the temperature information indicates a temperature gradient of the temperature of the substrate above a threshold temperature gradient essentially in the movement direction.

5. The soil compactor according to claim 1, wherein the temperature detecting device comprises at least one, preferably a plurality, of optical temperature sensors.

6. The soil compactor according to claim 1, wherein the temperature detecting device comprises at least one temperature sensor for detecting the temperature of the substrate in front of the soil compactor during movement of the soil compactor in a first movement direction and at least one temperature sensor for detecting the temperature of the substrate in front of the soil compactor during movement of the soil compactor in a second movement direction opposite the first movement direction.

7. The soil compactor according to claim 1, wherein a scraper/distribution device is provided, assigned to the at least one compacting roller, comprising at least one scraper/distribution element which can be brought into contact with an outer circumferential surface of the at least one compacting roller, and the control device is designed to control a positioning element of the scraper/distribution device for positioning the at least one scraper/distribution element in a scraping/distributing operating state with the at least one scraper/distribution element contacting the outer circumferential surface of the assigned compacting roller when a sprinkling device assigned to the assigned compacting roller is controlled to sprinkle the assigned compacting roller, and/or the control device is designed to generate an out of service indicator when the at least one sprinkling device is controlled for sprinkling a compacting roller, preferably when an operating state detection device of the scraper/distribution device assigned to the assigned compacting roller indicates that the at least one scraper/distribution element of the scraper/distribution device is not in the scraping/distributing operating state.

8. The soil compactor according to claim 1, wherein the control device is designed to control the at least one sprinkling device to not sprinkle, and/or to not generate the sprinkling indicator, and/or is designed to control the at least one sprinkling device to stop the sprinkling and/or to generate the stop-sprinkling indicator when the roller temperature information indicates a roller temperature over a roller threshold temperature.

9. The soil compactor according to claim 8, wherein the roller threshold temperature lies in the range from 70° C. to 90° C., preferably at approximately 80° C.

10. The soil compactor according to claim 1, wherein the at least one compacting roller is designed with a roller jacket constructed from a metal material, and/or the at least one compacting roller comprises a wheel with a tire constructed using rubber material.

11. A soil compactor, comprising at least one compacting roller rotatable about an axis of rotation, wherein:

a temperature detecting device for providing temperature information representing a temperature of a substrate in the area of the soil compactor, a sprinkling arrangement assigned to at least one compacting roller for sprinkling this compacting roller with fluid, and a control device for controlling at least one sprinkling device and/or for generating a sprinkling indicator on the basis of the temperature information, wherein the control device is designed to control the at least one sprinkling device for sprinkling the assigned compacting roller when the temperature information indicates a temperature of the substrate is above a threshold temperature and/or for generating the sprinkling indicator when the temperature information indicates a temperature of the substrate is above a threshold temperature.

12. A method for compacting a substrate, comprising:

a) providing temperature information indicating a temperature of the substrate in the area of a soil compactor used for compacting, b) sprinkling at least one compacting roller of the soil compactor with fluid and/or generating a sprinkling indicator as a function of the temperature information, and c) providing roller temperature information indicating a roller temperature of the at least one compacting roller, and that the at least one compacting roller is not sprinkled with fluid and/or a sprinkling indicator is not generated, and/or the sprinkling of the at least one compacting is stopped and/or a stop-sprinkling indicator is generated when the roller temperature information indicates the roller temperature is above the roller threshold temperature.

13. The method according to claim 12, wherein the at least one compacting roller is sprinkled and/or the sprinkling indicator is generated when the temperature information indicates the temperature of the substrate is above a threshold temperature and/or when, during movement of the soil compactor in a movement direction, the temperature information indicates a temperature gradient of the temperature of the substrate above a threshold temperature gradient essentially in the movement direction.

14. A soil compactor, comprising at least one compacting roller rotatable about an axis of rotation, wherein:

a temperature detecting device for providing temperature information representing a temperature of a substrate in the area of the soil compactor, a sprinkling arrangement assigned to at least one compacting roller for sprinkling this compacting roller with fluid, a control device for controlling at least one sprinkling device and/or for generating a sprinkling indicator on the basis of the temperature information, and a scraper/distribution device is provided, assigned to the at least one compacting roller, comprising at least one scraper/distribution element which can be brought into contact with an outer circumferential surface of the at least one compacting roller, and the control device is designed to control a positioning element of the scraper/distribution device for positioning the at least one scraper/distribution element in a scraping/distributing operating state with the at least one scraper/distribution element contacting the outer circumferential surface of the assigned compacting roller when a sprinkling device assigned to the assigned compacting roller is controlled to sprinkle the assigned compacting roller, and/or the control device is designed to generate an out of service indicator when the at least one sprinkling device is controlled for sprinkling a compacting roller, preferably when an operating state detection device of the scraper/distribution device assigned to this compacting roller indicates that the at least one scraper/distribution element of the scraper/distribution device is not in the scraping/distributing operating state.

15. The method according to claim 12, wherein at least one scraper/distribution device assigned to a compacting roller is sprinkled, and/or that an out of service indicator is generated when the at least one compacting roller is sprinkled, preferably when the at least one scraper/distribution device assigned to the at least one compacting roller is not in a scraping/distributing operating state.

16. A method for compacting a substrate, comprising:

a) providing temperature information indicating a temperature of the substrate in the area of a soil compactor used for compacting, b) sprinkling at least one compacting roller of the soil compactor with fluid and/or generating a sprinkling indicator as a function of the temperature information, wherein at least one scraper/distribution device assigned to a compacting roller is sprinkled, and/or that an out of service indicator is generated when the at least one compacting roller is sprinkled, preferably when the at least one scraper/distribution device assigned to the at least one compacting roller is not in a scraping/distributing operating state.

* * * * *